United States Patent [19]

Varlonga

[11] 4,171,596

[45] Oct. 23, 1979

[54] PREFABRICATED ROOM STRUCTURE FOR FACILITIES IN GENERAL SUCH AS TOILETS, BATHS, KITCHENS AND THE LIKE

[75] Inventor: Giovanni Varlonga, Milan, Italy

[73] Assignee: Fonderia Elettrica Allumino e Leghe F.E.A.L. S.p.A., Milan, Italy

[21] Appl. No.: 838,040

[22] Filed: Sep. 29, 1977

[30] Foreign Application Priority Data

Oct. 4, 1976 [IT] Italy ..... 27967 A/76

[51] Int. Cl.[2] ..... E04H 1/12

[52] U.S. Cl. ..... 52/79.5; 52/143; 52/264

[58] Field of Search ..... 52/79.1, 79.5, 79.9, 52/79.12, 220, 221, 745, 264, 265, 143

[56] References Cited

U.S. PATENT DOCUMENTS

| | | | |
|---|---|---|---|
| 1,683,600 | 9/1928 | Black | 52/220 |
| 1,978,842 | 10/1934 | Hooton | 52/220 |
| 2,712,863 | 7/1955 | Busch | 52/79.1 |
| 3,717,964 | 2/1973 | Brown | 52/79.1 |
| 3,727,753 | 4/1973 | Starr | 52/79.5 |
| 3,742,666 | 7/1973 | Antoniou | 52/79.1 |
| 3,792,558 | 2/1974 | Berce | 52/79.12 |

*Primary Examiner*—Price C. Faw, Jr.
*Assistant Examiner*—H. E. Raduazo
*Attorney, Agent, or Firm*—Guido Modiano; Albert Josif

[57] ABSTRACT

Prefabricated room structure for facilities in general, such as toilets, bathrooms, kitchens and the like, suitable for installation in a finished form into a building, in which there are prepared separately and in finished form: lateral walls floor and ceiling of the room structure. The so prefabricated finished wall, floor-and-ceiling component parts of the room structure are assembled together on the site by screw fastening and/or welding together the jointed formations to obtain the room structure in the form of a box-like member ready to be installed into the building as a unit.

3 Claims, 28 Drawing Figures

1
2
3
8
9
9a
10
11
4
5
6
7
18
18a
19
20

26
26
19

18a
18b
19
20
22
21
21a
18'
18a
18b
26
26
21a
21
24
23
24
18
21
23
21
21a
22
13
18b
18a 22
18a
18b
22

18a
22
20
21
19
21a
23
24
22
18a 15
34
32
16
6
36
33
38
29
34
17
37
14
25
35
34
12
A
13
A
37

PREFABRICATED ROOM STRUCTURE FOR FACILITIES IN GENERAL SUCH AS TOILETS, BATHS, KITCHENS AND THE LIKE

BACKGROUND OF THE INVENTION

This invention relates to a prefabricated room structure for facilities in general such as toilets, baths, kitchens and the like.

Known and currently marketed are toilet room or bath room unit structures which are delivered by the pre-fabrication plant in a completely assembled and finished condition, to be simply installed directly in a building under construction, the only additional requirement being the connecting of the structure to the building systems. Some of them are built as single blocks of reinforced concrete, preferably to be obtained in a single casting step. While such structures are quite economical, they tend to be so heavy as to exceed the load standards approved for the floors of residential buildings, thereby the floors have to be suitably strengthened at the toilet room or bathroom areas. To obviate this shortcoming, a very light metal frame structure has been developed, wherein section members are welded to one another along the edges of a parallelepipedon shape; plates and panels are then added to the frame to complete the room. Thus, an improved structure can be obtained over the previous ones, as mentioned, which is easier to handle and install, and requires no strengthening of the bearing structures, being also easily adjustable to suit individual dimension requirements, since the need for costly molds is eliminated. However, even this latter type of integrally pre-fabricated structure, like all the others currently employed, similar to the ones just described, have the disadvantage of being difficult to line with tiles along the vertical walls. While this operation is made easier by the structure being completed at the pre-fabrication plant rather than on the job site, it is apparent that it would be advantageous still to add such tiles while the walls are laid horizontal. Also desirable would be to assemble, either completely or in part, each wall prior to the construction of the box-like member.

SUMMARY OF THE INVENTION

Thus, it is an object of this invention to obviate the cited drawbacks in the pre-fabrication of room units for facilities in general.

It is a particular object of the invention to provide a facilities room unit to be installed in a finished condition into a building, wherein the tiles are applied to the walls while laid horizontally.

It is a further object of this invention to provide a facilities room unit, as above, which may be easily assembled, prior to the installation thereof in a building, at the pre-fabrication plant, or alternatively at any construction site, thereby taken-apart walls become transportable over distances with less bulk than box-like members.

These and other objects, such as will be apparent hereinafter, are achieved by a method of constructing a facilities room suitable for installation in a finished form into a building, characterized in that the walls, floor and ceiling thereof are completed separately, and then united together by jointing and screw fastening and/or welding, to form with a simple assembling operation a box-like member which is thus ready to be installed as a unit.

BRIEF DESCRIPTION OF THE DRAWINGS

The invention features and advantages will be illustrated in a more detailed form through the following description of a preferred embodiment thereof, presented herein by way of example and not of limitation with the aid of the accompanying drawings.

In the drawings.

DESCRIPTION OF THE PREFERRED EMBODIMENTS

Figures 1, 2, 3, 4, 5, 6, 7:
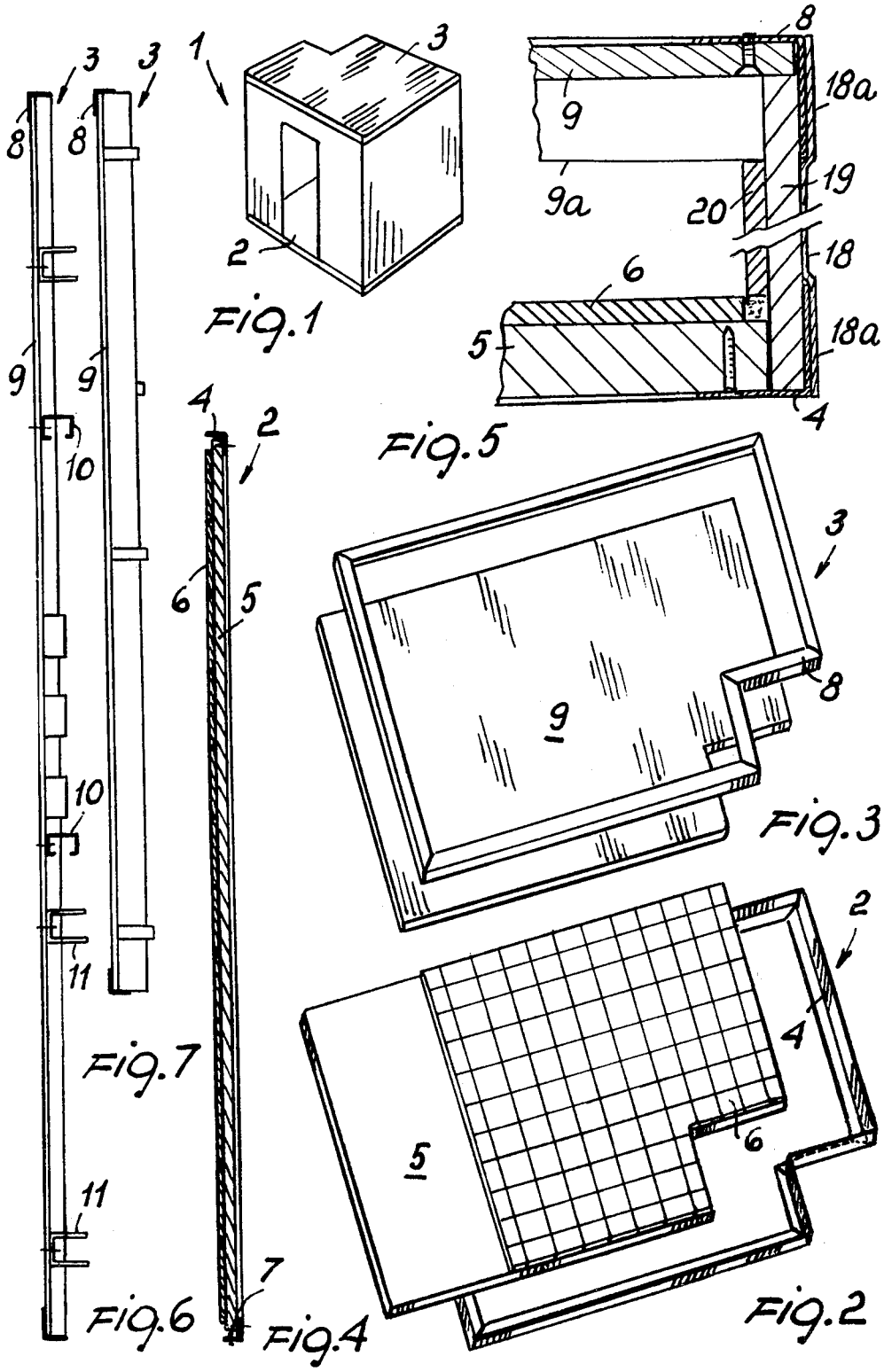
FIG. 1 is a perspective view of a pre-fabricated toilet room according to this invention.
FIGS. 2 and 3 show an exploded perspective view of the toilet room floor and ceiling.
FIG. 4 is a sectional view of the floor.
FIG. 5 shows enlarged scale details of the floor and ceiling joints, in section.
FIG. 6 is a longitudinal sectional view of the ceiling.
FIG. 7 is a cross-sectional view of the ceiling.

A toilet room of the type for interior installation, without windows, is shown completed in FIG. 1 and generally indicated at 1. The floor 2 and ceiling 3 are shown in exploded view in FIGS. 2 and 3 and in section in FIGS. 4 to 7. The floor 2 comprises an angle section floor frame 4 composed of L-like angle sections with a projecting edge facing upwards, which encircles a floor panel 5 made of resin bonded chips, known per se, whereon a layer of tiles 6 is laid; between the edge of the tiled panel and the frame, there extends an interspace 7 intended for jointing. The ceiling is formed by an angle section ceiling frame 8, composed of L-like angle sections with an edge facing downwards, which surrounds a ceiling panel 9 which may also be of resin bonded chips, reinforced with channel members 10; suspended from the ceiling are electric cables, electric current taps, etc., which are covered with a false ceiling 9*a* (FIG. 5) suspended from brackets 11. The room is generally rectangular in plan view, with a conspicuous recess at one corner to accomodate a shaft 12 for drain, supply and ventilation air ducts.

Figures 8, 9, 10, 11, 12:
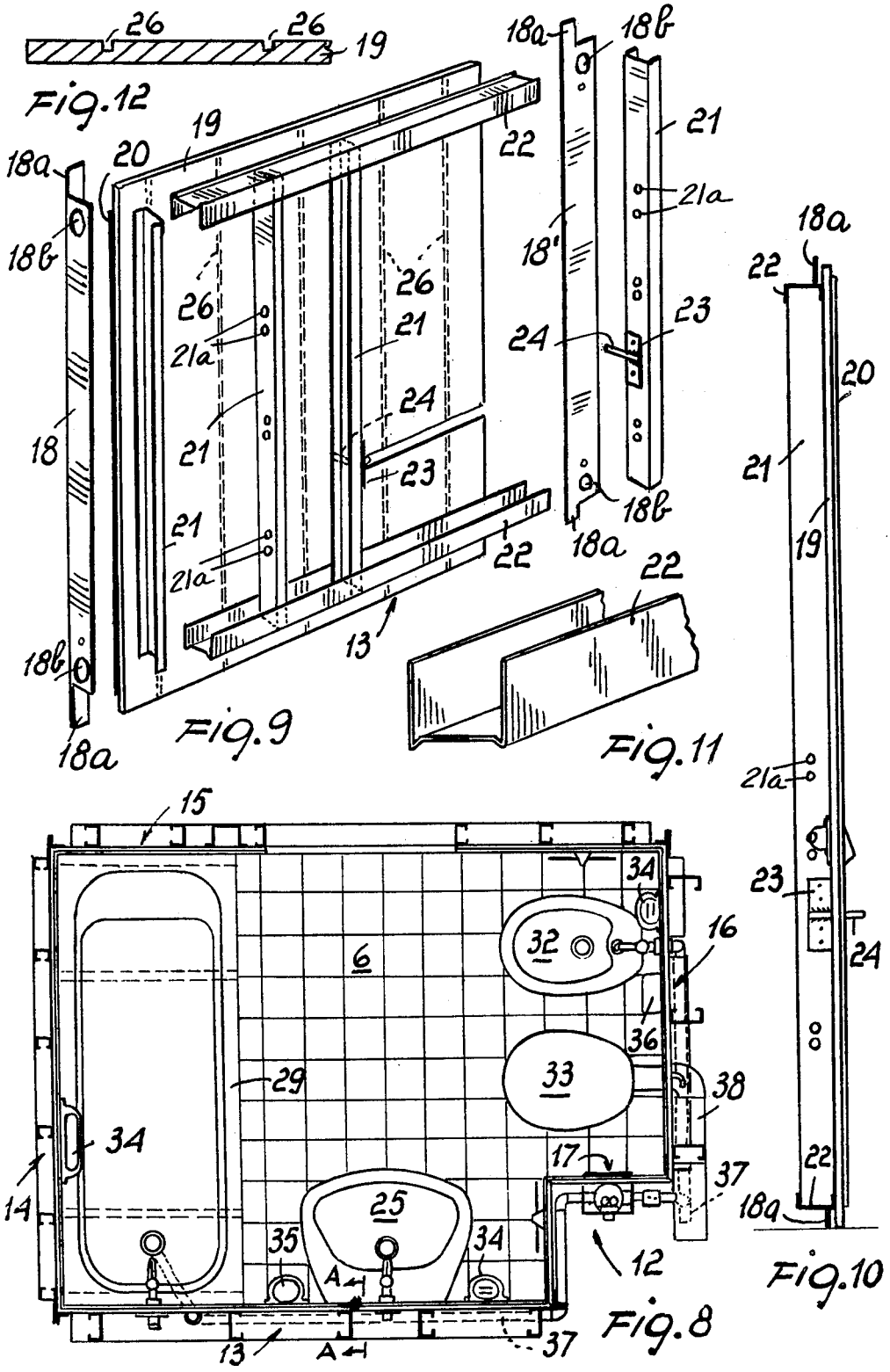
FIG. 8 is a plan view of the completed room.
FIG. 9 is an exploded perspective view of a wall as seen from the back.
FIGS. 10, 11 and 12 are detail views of that wall.

Between the two frames 4 and 8, which are suitably arranged with their projecting edges facing each other, and inserted in the spaces 7, are the walls of the room, which in the plan view of FIG. 8 are indicated at 13 the wash basin wall, at 14 the bath tub wall, at 15 the door wall, at 16 the bidet wall, and at 17 the recessed walls of the shaft 12.

A wall construction, as seen from the outside, is shown in FIG. 9 with the two angle uprights 18 and 18' in alignment and slightly moved apart to evidence the connections. Each wall comprises a panel 19, with tiles 20, reinforcing channel section uprights 21 and horizontal shaped channels 22 of U-like configuration near the edges of the wall. The wall shown in FIG. 9 is the wall 13. As shown in FIG. 9, the uprights 21 extend transverse to the walls 19.

Figures 17, 18, 19, 20, 21, 22, 23, 24, 25, 26, 27, 28:
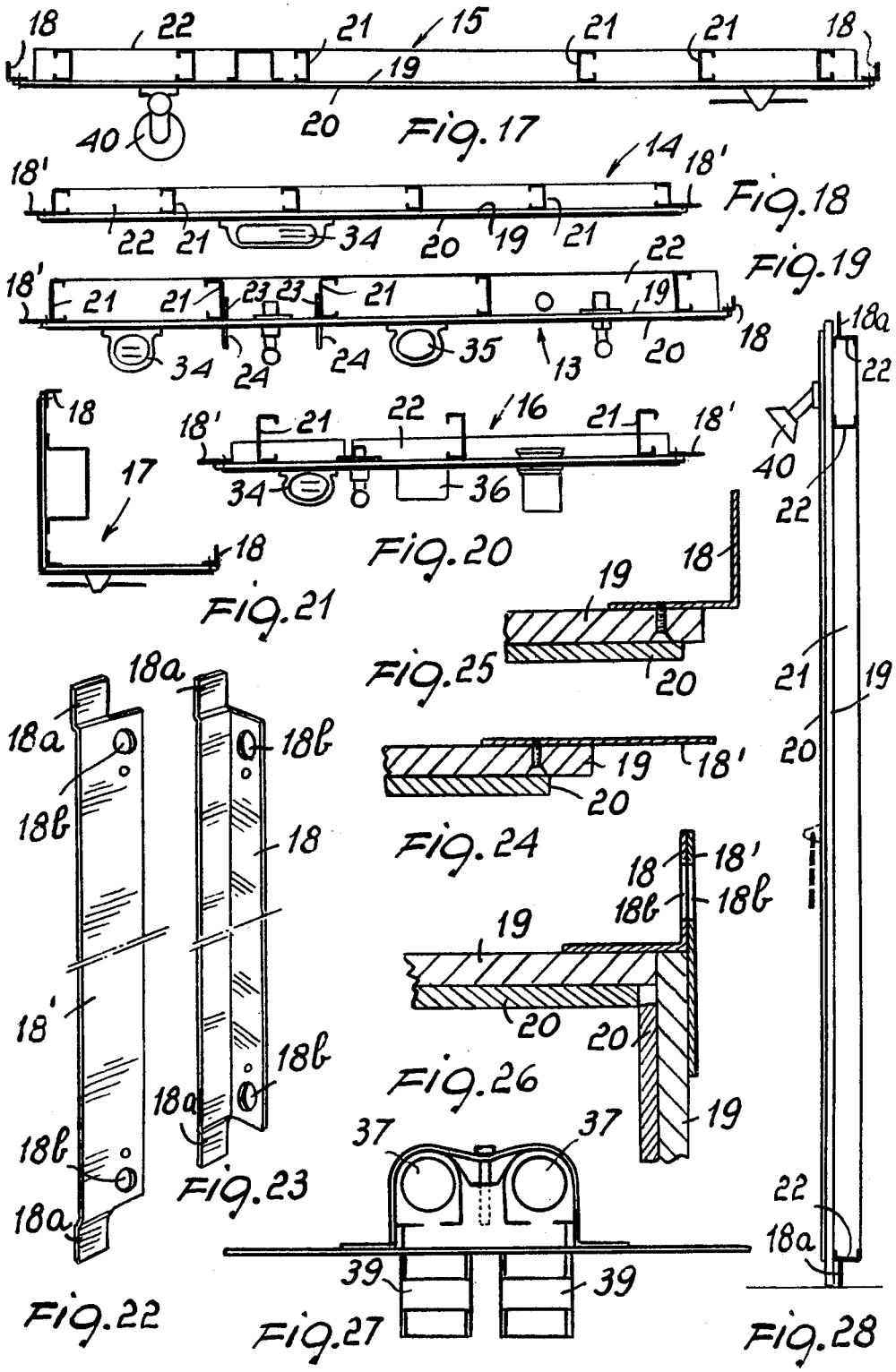
FIGS. 17 to 21 are plan views of the walls.
FIGS. 22 to 26 are detail views of the fasteners for the angle and flat uprights.
FIG. 27 is a vertical section through a plumbing connection.
FIG. 28 is a sectional view taken along the line A—A of FIG. 15.

A section upright 21 is shown removed from the structure: it comprises a plate 23 welded to its back at a certain height, wherefrom a rod 24 projects which is rigidly mounted thereto. As can be seen in FIG. 19 as well, two similar section members 21 with projecting members like rods 24 are mounted parallel, with opposite profiles, so spaced apart as to cause the two rods 24 to extend like spigots from the wall 13 to support a wash basin 25. Through bores 21*a* are provided in the uprights 21 for supporting pipes and the like. FIG. 10 is a section taken along the line A—A of FIG. 8, i.e. of that same wall whereof FIG. 11 shows a detail of the lower section member 22, arranged to accomodate in its hollow the vertical section members 21, and FIG. 12 a partial section of the panel 19. Along the panel, in a vertical direction, there are machined deep spaces grooves 26 which extend substantially parallel to the uprights 21 on the side opposite thereto and which to take up any deformation stresses which might indent the panel following the application of the tiles.

Figure 13:
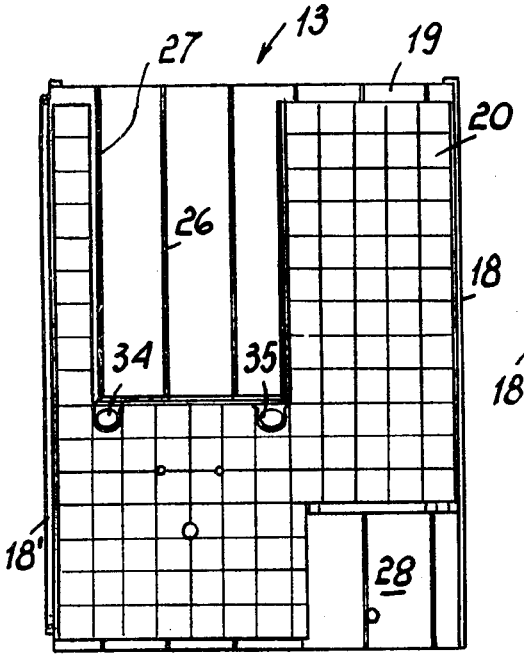
FIGS. 13 to 16 are front views of the walls.
Figure 14:
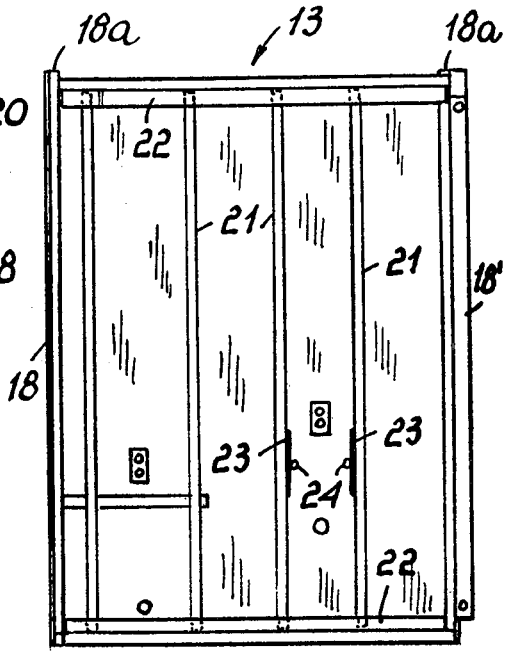
Figure 15:
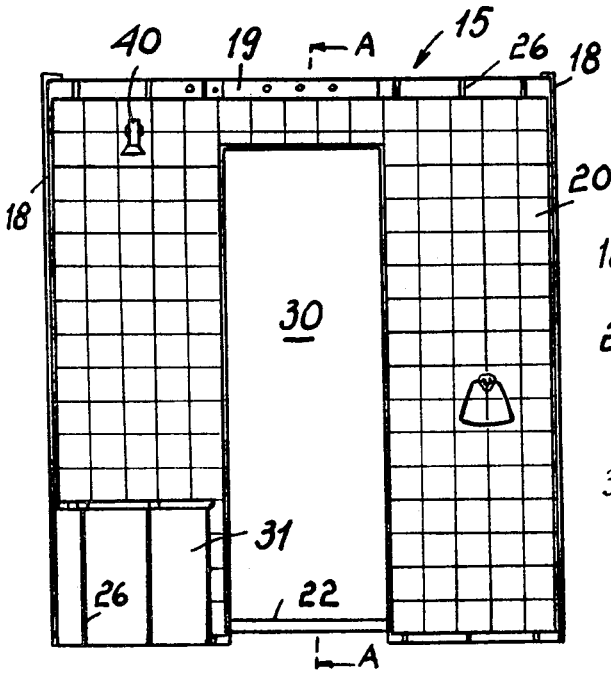
Figure 16:
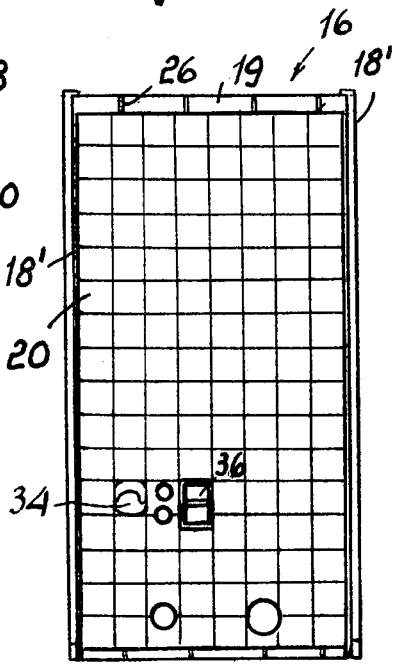

In FIGS. 13 and 14, that same wall 13, already illustrated in exploded and vertical section views, is shown in front view from the inside and respectively outside of the room; the numerals 27 and 28 denote the seatings for a mirror and one end of the bath tub 29. The door wall 15 and bidet wall 16 are viewed frontally in FIGS. 15 and 16, respectively. A door bay 30 and seating 31 for the other end of the bath tub may be observed therein. All the room walls, including the recessed walls 17, are viewed in plan in the following FIGS. 17 to 21. It may be noted that the vertical section members or upright members 21 are selected of a larger or smaller size according to the weight wherewith the respective walls are to be loaded and to the piping they are to accomodate.

FIGS. 22 and 23 show enlarged scale views of two side or end uprights 18' and 18 of the walls, evidencing a few peculiarities: the upright 18' is flat, the upright 18 is an angle or "L" section; both have upwardly and downwardly projecting tabs 18*a* for insertion on the projecting edges of the floor and ceiling frames 4 and 8, as shown in FIG. 5; close the upper and lower ends of the projecting web they are both formed with a hole 18*b* intended for lifting a completed and finished unit by hooking onto a crane. FIGS. 24 and 25 illustrate how the wall edges are attached to the uprights 18 and 18'. How the contiguous walls are caused to be coupled together along the vertical edges can be appreciated generally from FIG. 26, and for each single case from the plan view of FIG. 8: the web of a flat upright overlaps the projecting web of the angle section upright in the contiguous wall forming together a corner of the room; the two webs may be fastened together with bolts, or preferably, by welding.

Still with reference to FIG. 8, the arrangement of the sanitary fittings along the walls may be appreciated; in addition to the wash basin 25 and bathtub 29, provision is made for a bidet 32 and WC cup 33; among others, soap cake holders 34, glass holders 35, and paper holder 36 project from the walls. The layout selected permits all of the utilities to be supplied from two walls only, 13 and 16, branching from the shaft 12. Through each such walls, there are led a pair of supply pipes 37 and a drain or discharge header 38, whereof only a portion is visible in the drawings. Preferably, these pipes are of a suitable plastics, already in use for such systems; they are prearranged in the wall during its pre-fabrication. FIG. 27 illustrates how the pipe pair 37 are run along a wall one on top of the other, and how a twin fitting 39 provides for branching off.

FIG. 28 is a vertical section through the door 30, for the fixed frame whereof are utilized the same reinforcing sectional members employed for the walls. An infrared lamp 40 can be observed as installed to supply radiant heat near the tub 6 and shower base.

Therefore, the fabrication method of a toilet room as above, which is an essential part of this invention, can be quickly understood.

The wall metal frames are assembled first, including any inserts, such as supply and discharge pipes. Then, onto the frame of each wall individually laid on a horizontal working surface, as well as on the floor and ceiling walls, the related panel is applied, and a layer of tiles is attached with adhesive to the panels, excepting for the ceiling. Thereafter, the walls of the room 1 are inserted in the space 7 at the edges of the floor frame, secured each to the floor by means of screw fasteners, and the uprights are welded to each other along the corners. Onto the box-like structure thus formed, the ceiling 3 is rested like a lid and is secured to the uprights and walls by welding and/or screw fasteners. Finally, the installation of the appliances and the inner connections are completed. At this point, the toilet room is ready for installation into a building, like a washing machine or similar. Furthermore, the walls may be mounted, depending on individual requirements, either at the plant of job site.

While the above description makes reference to details of a practical embodiment of this invention, it is not intended to restrict the invention scope to such an embodiment but rather include any other alternatives and variations based upon the same principle and general concept as pointed out in the annexed claims.

I claim:

1. A prefabricated room structure for facilitate like toilets, baths, kitchens, comprising in combination a floor frame having a generally rectangular shape and composed of angle sections of substantially L-like configuration, a floor panel having a contour substantially corresponding to said generally rectangular shape of said floor frame for arrangement on and inside said frame, said floor panel having dimensions slightly smaller than said floor frame to define an interspace between said floor panel and said floor frame all around the periphery thereof, peripheral walls for mating arrangement within said interspace all around said floor frame, said walls having peripheral edges, a ceiling frame having a generally rectangular shape corresponding to that of said floor frame and composed of angle sections of substantially L-like configuration, a ceiling panel having a contour substantially corresponding to that of said ceiling frame for arrangement within said ceiling frame, a plurality of shaped section uprights secured to said walls transverse thereto, angle uprights for connecting said walls between each other at corresponding of said peripheral edges, a plurality of through bores in said shaped section uprights for supporting pipes, shaped channels secured to said walls substantially perpendicularly to said shaped section uprights near said peripheral edges of said walls, projecting members on some of said shaped section uprights and said walls extending through the corresponding of said walls for supporting room equipment in the prefabricated structure, tiles secured to at least part of said panels and walls, and means for connecting said walls to said frames.

2. A prefabricated room structure as claimed in claim 1, wherein said floor frame, said ceiling frame, said floor panel and said ceiling panel each have a contour defining a recess at one corner of said generally rectangular shape.

3. A prefabricated room structure as claimed in claim 1, wherein said walls each have spaced grooves extending substantially parallel to said shaped section uprights on the side opposite to said shaped section uprights.

* * * * *